US010914167B2

(12) United States Patent
Scott et al.

(10) Patent No.: US 10,914,167 B2
(45) Date of Patent: Feb. 9, 2021

(54) SYSTEM FOR DEPLOYING COMMUNICATION COMPONENTS IN A BOREHOLE

(71) Applicants: Thomas McClain Scott, Cypress, TX (US); James Joseph Freeman, Houston, TX (US); Ermanel Isidro, Pearland, TX (US)

(72) Inventors: Thomas McClain Scott, Cypress, TX (US); James Joseph Freeman, Houston, TX (US); Ermanel Isidro, Pearland, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 129 days.

(21) Appl. No.: 16/049,190

(22) Filed: Jul. 30, 2018

(65) Prior Publication Data

US 2019/0040737 A1 Feb. 7, 2019

Related U.S. Application Data

(60) Provisional application No. 62/541,442, filed on Aug. 4, 2017.

(51) Int. Cl.
*E21B 47/13* (2012.01)
*E21B 47/14* (2006.01)
(Continued)

(52) U.S. Cl.
CPC ..... *E21B 47/13* (2020.05); *E21B 19/008* (2013.01); *E21B 47/007* (2020.05); *E21B 47/06* (2013.01);
(Continued)

(58) Field of Classification Search
CPC ..... E21B 47/01; E21B 47/14; E21B 47/122; E21B 47/065; E21B 47/0006; E21B 47/06; E21B 19/008
See application file for complete search history.

(56) References Cited

U.S. PATENT DOCUMENTS

2005/0056418 A1* 3/2005 Nguyen ..... E21B 43/26 166/250.1
2010/0096848 A1* 4/2010 McKee ..... E21B 17/20 285/39

(Continued)

FOREIGN PATENT DOCUMENTS

WO 2013019417 A2 2/2013

OTHER PUBLICATIONS

International Search Report and the Written Opinion of the International Searching Authority, or the Declaration: PCT/US2018/044376; dated Nov. 14, 2018; 11 pages.

*Primary Examiner* — David Carroll
(74) *Attorney, Agent, or Firm* — Cantor Colburn LLP

(57) ABSTRACT

An apparatus for deploying one or more components of a borehole monitoring system includes a conductor assembly having one or more communication devices connected along a length of a conductor, each communication device being configured to wirelessly communicate data and/or power, the conductor configured to transmit the data and/or the power through a borehole in an earth formation. The apparatus further includes a deployment device configured to transport and support the length of the conductor having the one or more communication devices connected along the length of the conductor and deploy the length of the conductor in the borehole.

18 Claims, 5 Drawing Sheets

(51) Int. Cl.

| | |
|---|---|
| ***E21B 19/00*** | (2006.01) |
| ***E21B 47/06*** | (2012.01) |
| ***E21B 47/10*** | (2012.01) |
| ***E21B 47/07*** | (2012.01) |
| ***E21B 47/007*** | (2012.01) |

(52) U.S. Cl.
CPC ..... *E21B 47/07* (2020.05); *E21B 47/101* (2013.01); *E21B 47/14* (2013.01)

(56) References Cited

U.S. PATENT DOCUMENTS

| | | | | |
|---|---|---|---|---|
| 2012/0169509 | A1 | 7/2012 | Coulston et al. | |
| 2014/0048286 | A1* | 2/2014 | Rojas | B65H 75/38 166/379 |
| 2014/0327552 | A1* | 11/2014 | Filas | E21B 47/16 340/854.6 |
| 2016/0369622 | A1* | 12/2016 | Wheeler | E21B 47/12 |
| 2017/0016316 | A1* | 1/2017 | Donzier | G01V 1/159 |

* cited by examiner

SYSTEM FOR DEPLOYING COMMUNICATION COMPONENTS IN A BOREHOLE

CROSS REFERENCE TO RELATED APPLICATIONS

This application claims the benefit of an earlier filing date from U.S. Provisional Application Ser. No. 62/541,442 filed Aug. 4, 2017, the entire disclosure of which is incorporated herein by reference.

BACKGROUND

Various operations are performed by the energy industry to evaluate earth formations and produce hydrocarbons. Such operations include drilling, stimulation and production. Various types of sensor devices and logging tools are utilized by the energy industry in order to evaluate earth formations and reservoirs, for purposes such as exploration, formation evaluation, stimulation and production.

For example, sensor devices may be deployed in a borehole as monitoring devices to monitor downhole conditions during production operations. Such deployments often require multiple field connections to be performed at the borehole site with resulting time and performance disadvantages.

BRIEF SUMMARY

Disclosed is an apparatus for deploying one or more components of a borehole monitoring system. The apparatus includes: a conductor assembly comprising one or more communication devices connected along a length of a conductor, each communication device being configured to wirelessly communicate data and/or power, the conductor configured to transmit the data and/or the power through a borehole in an earth formation; and a deployment device configured to transport and support the length of the conductor comprising the one or more communication devices connected along the length of the conductor and deploy the length of the conductor in the borehole.

Also disclosed is a method for deploying one or more components of a borehole monitoring system. The method includes: connecting one or more communication devices along a length of a conductor in a controlled environment to form a conductor assembly, each communication device being configured to wirelessly communicate data and/or power, the conductor configured to transmit the data and/or the power through a borehole in an earth formation; loading the conductor assembly onto a deployment device configured to transport and support the length of the conductor having the one or more communication devices connected along the length of the conductor and deploy the length of the conductor in the borehole; and deploying the conductor assembly from the deployment device into the borehole.

BRIEF DESCRIPTION OF THE DRAWINGS

The following descriptions should not be considered limiting in any way. With reference to the accompanying drawings, like elements are numbered alike.

DETAILED DESCRIPTION

Systems, apparatuses and methods are described herein for monitoring a borehole and/or otherwise sensing downhole parameters. Systems, apparatuses and methods are also described herein for deploying the borehole monitoring system in a borehole and performing an energy industry operation.

An embodiment of the borehole monitoring system includes a deployment device (e.g., a spool) configured to support a conductor assembly that includes a length of a conductor and one or more wireless or contactless communication devices attached to the conductor length and arrayed along the conductor length. For example, the spool or other deployment device includes a length of a tubing encapsulated conductor (TEC) or other type of cable or conductor that can convey electrical, inductive or acoustic energy, and having one or more acoustic communication devices attached thereto. In one embodiment, each communication device is integrated into the conductor by splicing, welding or otherwise attaching each communication device to the conductor length prior to transporting the deployment device and/or prior to unwinding or deploying the conductor length from the deployment device.

The borehole monitoring system may also include one or more carriers disposed at one or more fixed locations relative to a borehole string, such as a casing and/or a production string. The monitoring system may be deployed by disposing successive lengths of the borehole string in a borehole and unwinding or otherwise removing a respective section of the conductor, and for each borehole string length having a fixed carrier, attaching one of the communication devices to the carrier. The carrier may also house or support one or more downhole devices configured to communicate with the communication device via a contactless communication technique, e.g., an acoustic or electromagnetic technique.

Embodiments described herein provide a deployment device and monitoring system that allow for deployment of integrated communication devices that are pre-assembled or pre-attached prior to deployment, which can provide substantial time and cost savings by reducing or eliminating the need to perform field connections. Embodiments also allow for convenient deployment of a conductor and integrated communication devices by attaching the communication devices at locations along the conductor that correspond to pre-selected locations or depths of each carrier when disposed in a borehole.

Figure 1:
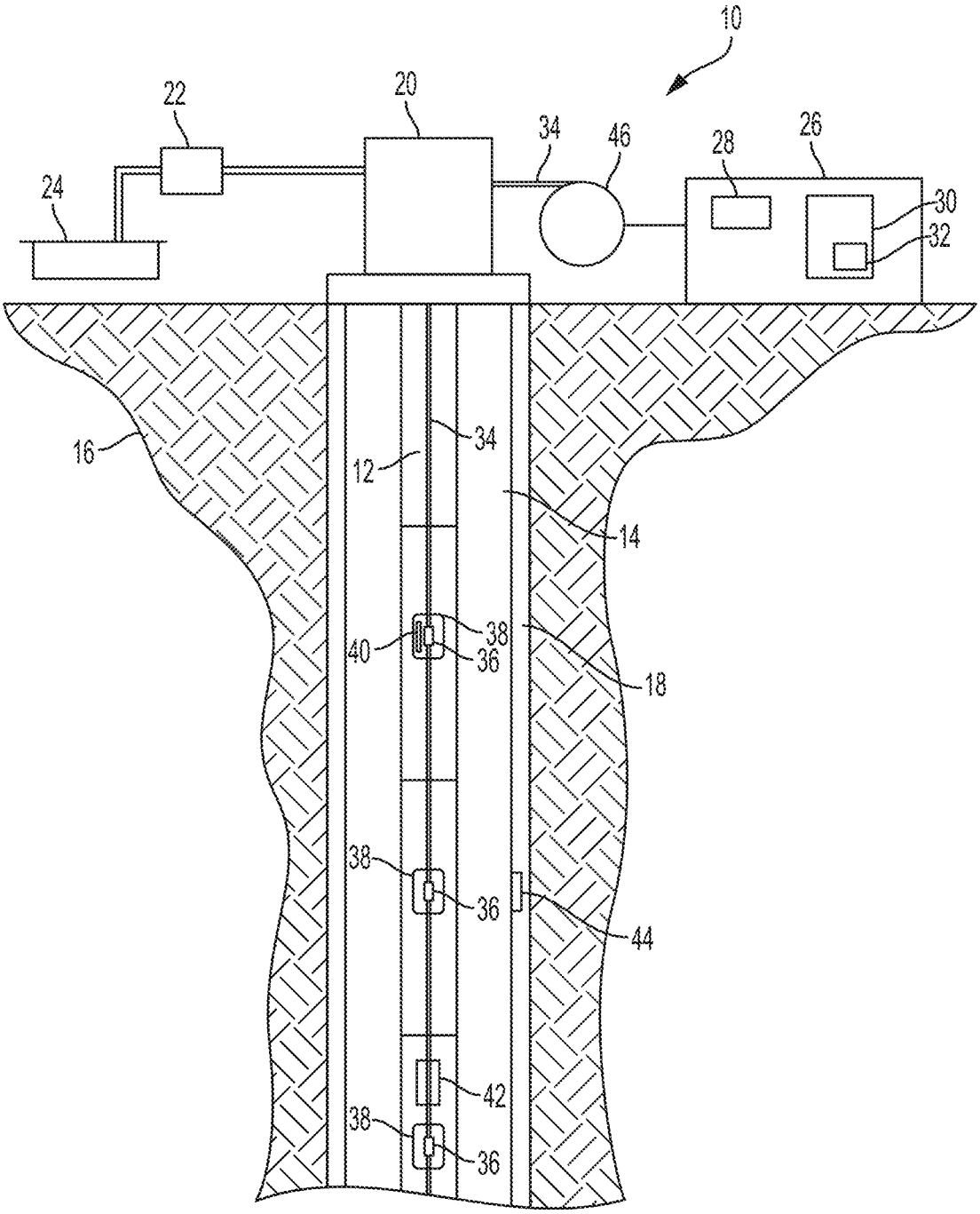
FIG. 1 depicts an embodiment of a system for performing an energy industry operation.

FIG. 1 illustrates an embodiment of a system 10 that can be used to perform one or more energy industry operations. The system 10 may be used to perform various energy industry operations, such as drilling, measurement, stimulation and/or production operations. The system 10 includes a borehole string 12 disposed in a borehole 14 that penetrates at least one earth formation 16. At least a portion of the borehole 14 may include a casing 18. In one example, the system 10 is configured as a production system in which the borehole string 12 is configured as production tubing deployed in the cased borehole 14.

The system 10 also includes a surface assembly 20 that includes various devices for performing or facilitating operations, such as a derrick, a platform, drilling equipment (e.g., a rotary table or top drive) and pumping devices. For example, the surface assembly 20 includes or is connected to a pump 22 that injects fluid (e.g., drilling mud, stimulation fluid) from a fluid source 24.

Although embodiments of the borehole string 12 are described herein as production tubing, the embodiments may be applied to any suitable string or string component, such as drill pipe, pipe segments, coiled tubing, wired pipe, wireline tools, logging-while-drilling (LWD) tools and measurement-while-drilling (MWD) tools. The system 10 and/or the drill string 12 may include various downhole components or assemblies, such as a drilling assembly (including, e.g., a drill bit and mud motor), various measurement tools and communication assemblies, packers, perforation devices, stimulation devices, one or more of which may be configured as a bottomhole assembly (BHA).

Sensors may be disposed at one or multiple locations along a borehole string, e.g., in the BHA, in the borehole string 12, in a logging sonde conveyed into the borehole via a wireline, or as distributed sensors. The sensors may be disposed at or deployed with the system 10 for controlling and monitoring aspects of an operation or for formation evaluation. Sensors may be disposed at the surface and/or downhole.

Various types of sensors may be included downhole for measuring parameters related to the downhole environment. Examples of such sensors include discrete sensors such as strain and/or temperature sensors. The system may also include one or more distributed sensor systems (in place of or in addition to the non-distributed sensors). The sensors might be located within the wall of the drill string, in the annular space between the drill string and the borehole wall, in the drill string bore and/or in casing. It is noted that the number and type of sensors described herein are exemplary and not intended to be limiting, as any suitable type and configuration of sensors can be employed to measure properties.

A processing unit 26 may be connected in operable communication with components of the system 10 and may be located, for example, at a surface location. The processing unit 26 may also be incorporated in the borehole string 12, or otherwise disposed downhole as desired. Components of the borehole string 12 or other borehole string may be connected to the processing unit 26 via any suitable communication regime, such as mud pulse telemetry, electromagnetic telemetry, wired links (e.g., hard wired drill pipe or coiled tubing), wireless links, optical links or others. The processing unit 26 may be configured to perform functions such as controlling deployment of downhole components, controlling operation of components, transmitting and receiving data, processing measurement data and/or monitoring operations. The processing unit 26, in one embodiment, includes a processor 28 and a data storage device (or a computer-readable medium) 30 for storing data, models and/or computer programs or software 32. Other processing devices may be included downhole, such as downhole electronics.

In one embodiment, the processing unit 26 is operably connected to a conductor 34 that is deployed in the borehole 14 with the borehole string. As described herein, a conductor generally refers to any type and number of electrical conductors, optical fibers and other mechanisms for transmitting communications, data, sensor signals, electrical power and other information. The conductor may be configured as, e.g., a cable or a tubing encapsulated conductor (TEC).

The system 10 also includes a borehole monitoring system that includes one or more lengths of the conductor 34 and one or more integrated communication devices 36 that are pre-connected to the conductor 34, i.e., connected to the conductor 34 prior to transporting the conductor 34 to a borehole site and/or prior to deploying the conductor 34 downhole. In one embodiment, the communication devices 36 are each configured as a wireless and contactless communication device that can communicate with a downhole component or component. Examples of such communication devices include acoustic devices and electromagnetic devices. The communication devices 36 can be configured to transmit power and/or information to a respective downhole component or components. The conductor 34 or a length thereof may be a single continuous conductor to which the communication devices 36 are connected and/or may include individual sections or lengths that are attached to communication devices 36 (e.g., via splicing) and form the conductor 34 or a length of the conductor 34.

The communication devices 36 can be configured to communicate wirelessly with any suitable downhole component(s). For example, as shown in FIG. 1, a communication device 36 can be deployed on a carrier 38 that is attached to the borehole string 12 and communicate with a sensor 40 that is also attached to the carrier 38. Each communication device 36 can be configured to communicate with one or more devices at various other locations, such as a sensor or tool 42 disposed on or in the borehole string 12 and/or a sensing device 44 incorporated in or attached to the casing 18.

In one embodiment, a length of the conductor 34 that includes the one or more communication devices 36 is stored on a deployment device such as a spool 46. The spool 46 can be operated manually by an operator, controlled by the operator in conjunction with a control device or controlled primarily by a control device such as the surface processing unit.

Figure 2:
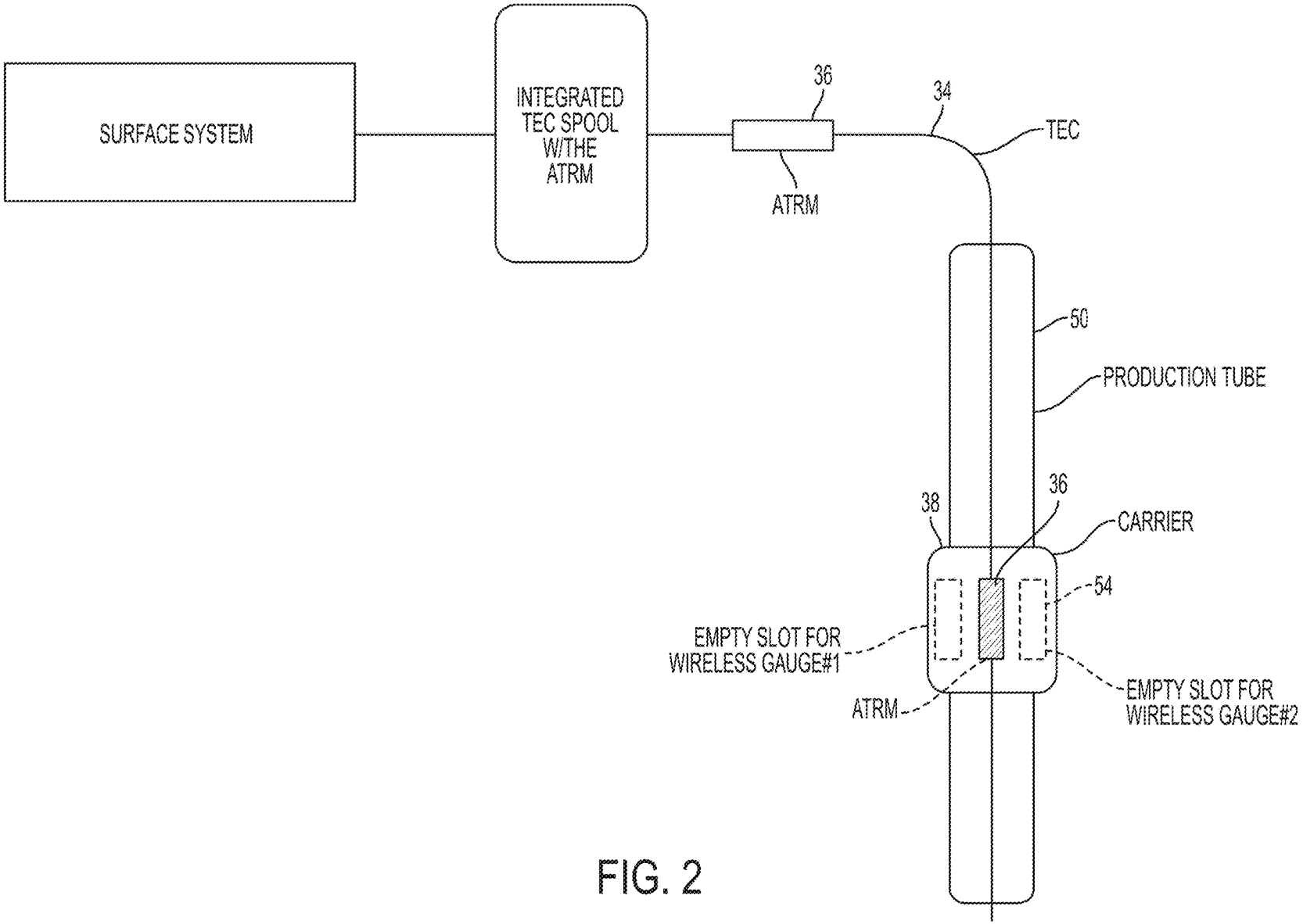
FIG. 2 depicts aspects of a borehole monitoring system.

FIG. 2 shows an example of the borehole monitoring system, which is connected to a surface system and includes a length of the conductor 34 wrapped around the spool 46. In this example, the conductor 34 is a tubing encapsulated conductor (TEC) having multiple communication devices 36 attached thereto. The communication devices 36 in this example are acoustic transmitter/receiver modules (ATRM).

As described herein, a conductor may be a single conductor (e.g., a wire or optical fiber) or may be a plurality of individual conductors, e.g., disposed in a cable or TEC. In addition, the conductor may be multiple cables, multiple TECs or multiple bundles of individual conductors As shown in this example, successive communication devices are arrayed along the conductor 34 so that the section of the conductor 34 between the communication devices 36 has a length that corresponds to a location on a respective borehole string section 50. In this way, when the communication device 36 is attached to the section 50, the section can be deployed and the next communication device 36 can be attached to a subsequent borehole string section without having to rewire, splice or otherwise perform any field connections or modifications to the conductor 34.

In one embodiment, a carrier 38 is attached or disposed at a fixed location on the borehole string section 50 is deployed, the carrier 38 can be attached at a desired location corresponding to the length of the section of the conductor 34. For example, the carrier 38 is welded, adhered or otherwise fixedly attached to the borehole string section 50. The carrier 38 may also be pre-attached to the borehole string section 50 prior to deployment, e.g., so that the entire monitoring assembly is pre-measured and pre-configured to allow for relatively simple deployment without requiring significant measurements or alterations.

Figure 3:
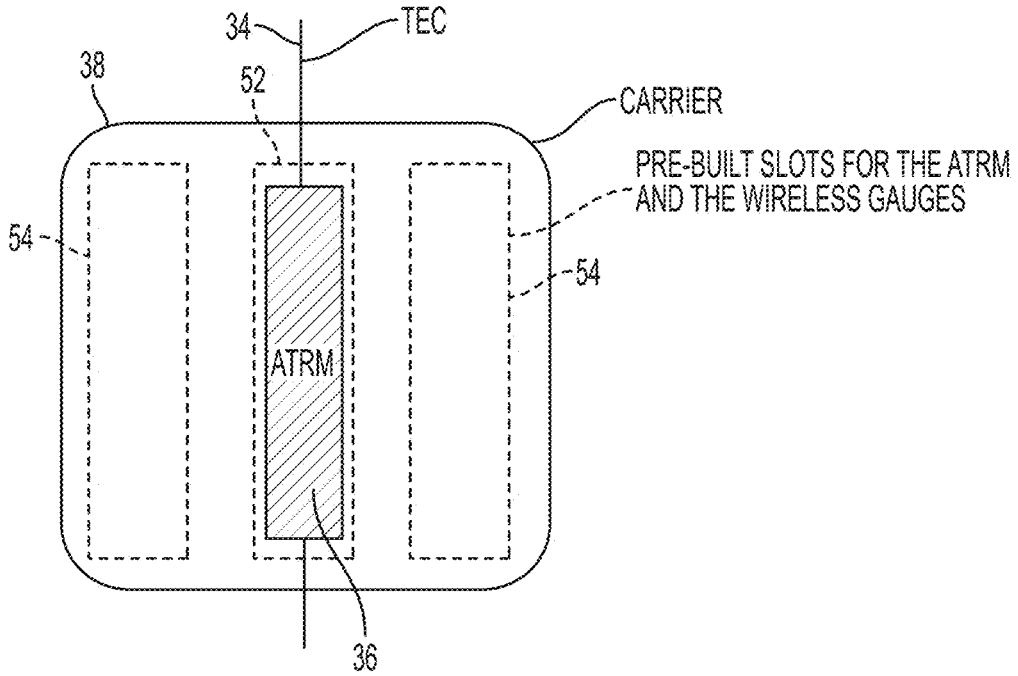
FIG. 3 depicts an embodiment of a carrier configured to be attached to a borehole string.
Figure 4:
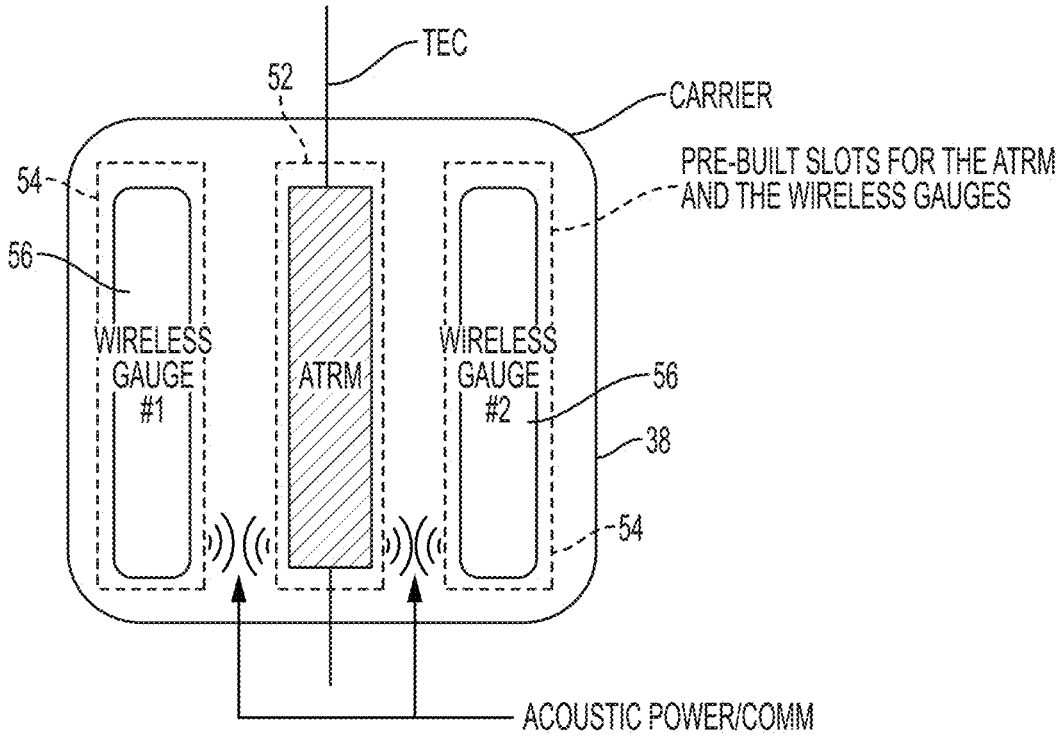
FIG. 4 depicts an embodiment of the carrier of FIG. 3.

FIGS. 3 and 4 illustrate an example of a carrier on which a communication device can be installed during deployment of a borehole string. In this example, the carrier 38 is a metallic or non-metallic housing or structure that includes one or more slots, recesses, panels, inserts or other features that allow at least the communication device to be attached.

For example, the carrier 38 includes a pre-built recess, slot or feature 52 in which the communication device 36. One or more additional slots, recesses or features 54 may also be incorporated into the carrier 38 to accommodate downhole components such as wireless gauges 56. The features may be positioned relative to each other so that wireless communications such as acoustic power/communication signals can be effectively transmitted.

Figure 5:
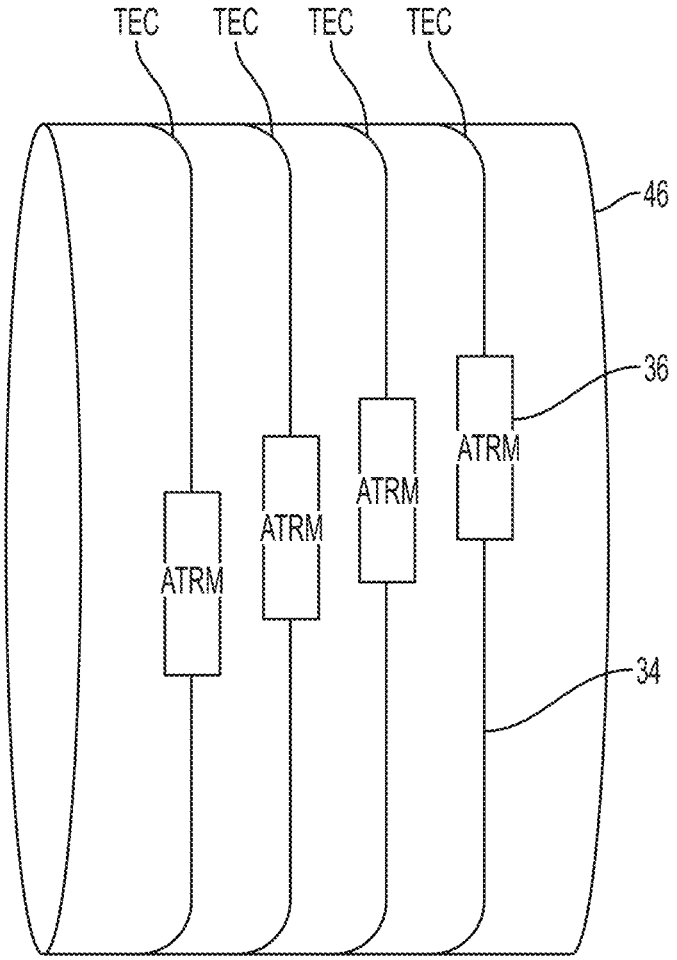
FIG. 5 depicts an embodiment of a deployment device of the borehole monitoring system of FIG. 2.

FIG. 5 shows an example of the deployment device, which is shown as a spool 46 but is not so limited. The integrated spool 46 is manufactured to have each of the communication devices 36 pre-welded or otherwise pre-connected to the conductor 34. Depths may be pre-determined for each communication device 36 before connecting to the conductor 34. This ensures that when installing each communication device at its selected depth or location in the borehole, the length of the conductor section (e.g., between the current communication device and a following communication device) is sufficient.

Figure 6:
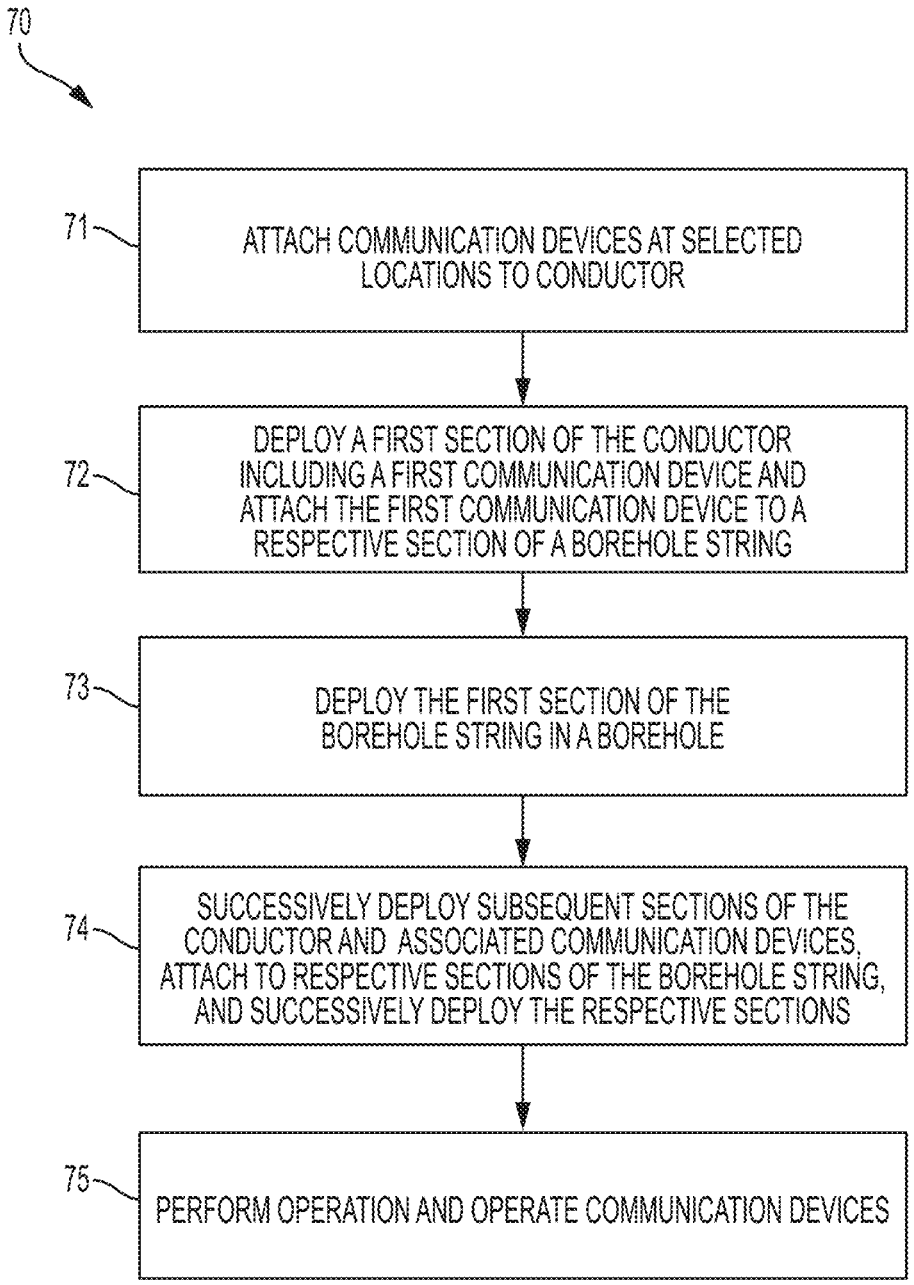
FIG. 6 is a flow chart providing an embodiment of a method of deploying a borehole monitoring system.

FIG. 6 illustrates a method 70 of deploying a borehole monitoring system in a borehole, performing downhole measurements and/or performing an energy industry operation. The method 70 is discussed in conjunction with the system 10, although the method 70 may be utilized in conjunction with any suitable combination of processors and networks. The method 70 includes one or more stages 71-75. In one embodiment, the method 70 includes the execution of all of stages 71-75 in the order described. However, certain stages may be omitted, stages may be added, or the order of the stages changed.

In the first stage 71, wireless communication devices are connected at selected locations to a length of a conductor prior to deployment. The length may be wound on a spool or otherwise disposed on a suitable support structure prior to deployment.

For example, individual lengths of the conductor are spliced to each communication device. The lengths may be selected to correspond to depths of downhole components and/or depths of a carrier to which one or more of the communication device is to be attached.

In the second stage 72, during deployment of a borehole string into a borehole, a first section of the conductor that includes a first communication device is unwound from the spool and the first communication device is attached to a first section of a borehole string.

For example, during run-in hole procedure, a communication device (e.g., an ATRM) and a downhole component such as one or more wireless gauges are installed onto the carrier, which may be attached to the first section of the borehole string during deployment or prior to deployment. When installed, functional checks can be performed to ensure wireless communication to and/or from the wireless gauges and the communication device.

In the third stage 73, the first section of the borehole string and the first section of the conductor is deployed downhole. The length of the first section of the conductor may be pre-determined so that it is not necessary to measure the section to ensure that a following communication device can be properly located on a subsequent borehole string section.

In the fourth stage 74, subsequent borehole string sections and corresponding communication devices and sections of the conductor are successively deployed. In one embodiment, the sections of the conductor (e.g., a TEC, cable and/or one or more wires, optical fibers or other conducting mechanisms) are deployed without cutting or separating the length of the conductor deployed downhole.

In one embodiment, multiple spools or support structures may be used as part of the methods and systems described herein. For example, an end of the conductor disposed on a first spool can have a connector or be configured to be spliced or otherwise connected to an additional length of conductor disposed on a second spool. An example of a mechanism for connecting the conductors is a contactless splice.

One or more of the multiple spools may be configured as discussed above, i.e., having one or more communication devices attached thereto at selected locations, or may not have this configuration. For example, one or more of the spools may have a conventional conductor length that can be used to simply extend the length of the conductor. Additional lengths can be attached to the conductor (from a spool or otherwise), such as relatively short conductor segments or instances where space out or other rig time actions require or cause a desire to change of the spacing of the communication devices.

In the fifth stage 75, an energy industry operation such as a production operation is performed, and the communication devices are operated as desired to communicate with downhole sensors and/or other components to monitor the borehole and perform any other desired functions.

The following is an example of the operation of the communication devices after deployment and/or during the operation. In this example, each communication device is an ATRM, and the conductor is a TEC line.

During operation of the borehole monitoring system, a surface system sends power and communication to a selected ATRM through the TEC line. When the ATRM is powered, it activates internal piezo transducers to send acoustic power to wireless gauge(s) for a given period of time.

In this example, each wireless gauge also has piezo transducers that receive acoustic signals and convert the acoustic signals to power. The power can be stored, e.g., in high-energy storage capacitors that store the energy received up to the time the ATRM turns off the power signals.

When enough energy is stored, electronics on the wireless gauge(s) obtain measurements such as pressure and temperature readings from transducers connected to the electronics. The measurements can then be processed and packetized to be ready for acoustic transmission. When ready, the electronics begin acoustic wireless transmission of the data packets to the ATRM through the same piezo transducers in the wireless gauge(s) that were used to receive power. The piezo transducers on the ATRM receive the data packets and send corresponding information upstream to the surface system through the TEC line, which can then display the measurements, store measurement data, control aspects of the borehole monitoring system, control aspects of an energy industry operation or otherwise perform any suitable or desired function.

Disclosed is another method for deploying one or more components of a borehole monitoring system. A first stage in this method calls for connecting one or more communication devices along a length of a conductor in a controlled environment to form a conductor assembly, each communication device being configured to wirelessly communicate data and/or power, the conductor configured to transmit the data and/or the power through a borehole in an earth formation. A second stage in this method calls for loading the conductor assembly onto a deployment device configured to transport and support the length of the conductor comprising the one or more communication devices connected along the length of the conductor and deploy the length of the conductor in the borehole. Non-limiting embodiments of the deployment device include a spool that can be manually operated by a user or automatically operated by a controller. A third stage of this method calls for deploying the conductor assembly from the deployment device into the borehole. In this method, deploying the conductor assembly can include: attaching a first length of the conductor assembly to a first length of a borehole string; deploying the first length of the borehole string into the borehole; attaching a following length of the conductor assembly to a following length of the borehole string; deploying the following length of the borehole string into the borehole; and iterating the attaching a following length of the conductor assembly and the deploying the following length of the borehole string until a selected length of the conductor assembly is deployed into the borehole. In this method, at least one of attaching a first length and attaching a following length can include securing one of more of the communication devices to a carrier attached to the borehole string. In this method, connecting one or more communication devices along a length of a conductor can include welding and/or pressure testing the connections of the one or more communication devices along the length of a conductor.

One or more aspects of the embodiments described herein can be included in an article of manufacture (e.g., one or more computer program products) having, for instance, computer usable media. The media has therein, for instance, computer readable instructions, program code means or logic (e.g., code, commands, rules, etc.) to provide and facilitate the capabilities of the present invention. The article of manufacture can be included as a part of a computer system or provided separately. These instructions may provide for equipment operation, control, data collection and analysis and other functions deemed relevant by a system designer, owner, user or other such personnel, in addition to the functions described in this disclosure.

The apparatuses and methods disclosed herein provide several advantages. One advantage is that the communication devices can be electrically connected to the conductor such as by welding in a controlled environment. In one or more embodiments, the controlled environment provides the proper temperature and/or cleanliness for making the connections. The proper cleanliness prevents contamination of the connections. The made-up connections can also be pressure tested in the controlled environment. The controlled environment, which can be in a laboratory for example, provides for making connections that are less prone to the problems that would be encountered by making those same connections in a field environment. Another advantage is that the borehole monitoring system can be deployed in much less time compared to the time that would be required if the connections were made in the field as the monitoring system was being disposed in the borehole. The time savings can lead to considerable cost savings. Yet another advantage involves use of the carrier on a borehole string. Use of the carrier saves further time by enabling quick attachment of the communication devices and/or downhole devices or sensors.

Set forth below are some embodiments of the foregoing disclosure:

Embodiment 1

An apparatus for deploying one or more components of a borehole monitoring system, the apparatus comprising: a conductor assembly comprising one or more communication devices connected along a length of a conductor, each communication device being configured to wirelessly communicate data and/or power, the conductor configured to transmit the data and/or the power through a borehole in an earth formation; and a deployment device configured to transport and support the length of the conductor comprising the one or more communication devices connected along the length of the conductor and deploy the length of the conductor in the borehole.

Embodiment 2

The apparatus of any prior embodiment, wherein the deployment device includes a spool.

Embodiment 3

The apparatus of any prior embodiment, wherein the spool is configured to be at least one of manually operated and automatically operated.

Embodiment 4

The apparatus of any prior embodiment, wherein each of the one or more communication devices is spaced along the length of the conductor such that a location of each communication device corresponds to a selected location on a borehole string deployed in the borehole.

Embodiment 5

The apparatus of any prior embodiment, further comprising one or more carriers fixed to the borehole string, each of the carriers being configured to have at least one of the communication devices attached thereto.

Embodiment 6

The apparatus of any prior embodiment, wherein the one or more carriers are spaced along the borehole string to correspond with the location of each communication device.

Embodiment 7

The apparatus of any prior embodiment, wherein the one or more communication devices are secured to the one or more carriers.

Embodiment 8

The apparatus of any prior embodiment, wherein at least one carrier is configured to have at least one downhole device attached thereto, the at least one downhole device being configured to communicate the data and/or the power with a corresponding communication device also attached to the at least one carrier.

Embodiment 9

The apparatus of any prior embodiment, further comprising one or more downhole devices configured to communicate the data and/or the power with one or more corresponding communication devices.

Embodiment 10

The apparatus of any prior embodiment, wherein at least one downhole device is a sensor.

Embodiment 11

The apparatus of any prior embodiment, wherein the sensor is configured to sense at least one of pressure, temperature, strain, and vibration.

Embodiment 12

The apparatus of any prior embodiment, wherein at least one of the one or more downhole devices is secured to a casing lining the borehole.

Embodiment 13

The apparatus of any prior embodiment, wherein at least one of the one or more downhole devices is secured to a borehole string deployed in the borehole.

Embodiment 14

The apparatus of any prior embodiment, wherein the conductor is encapsulated by tubing to form a tubing encapsulated conductor (TEC).

Embodiment 15

The apparatus of any prior embodiment, wherein each communication device is configured to wirelessly communicate the data and/or power using at least one of acoustic energy and electromagnetic energy.

Embodiment 16

A method for deploying one or more components of a borehole monitoring system, the method comprising: connecting one or more communication devices along a length of a conductor in a controlled environment to form a conductor assembly, each communication device being configured to wirelessly communicate data and/or power, the conductor configured to transmit the data and/or the power through a borehole in an earth formation; loading the conductor assembly onto a deployment device configured to transport and support the length of the conductor comprising the one or more communication devices connected along the length of the conductor and deploy the length of the conductor in the borehole; and deploying the conductor assembly from the deployment device into the borehole.

Embodiment 17

The method of any prior embodiment, wherein deploying the conductor assembly comprises: attaching a first length of the conductor assembly to a first length of a borehole string; deploying the first length of the borehole string into the borehole; attaching a following length of the conductor assembly to a following length of the borehole string; deploying the following length of the borehole string into the borehole; and iterating the attaching a following length of the conductor assembly and the deploying the following length of the borehole string until a selected length of the conductor assembly is deployed into the borehole.

Embodiment 18

The method of any prior embodiment, wherein at least one of attaching a first length and attaching a following length comprises securing one of more of the communication devices to a carrier attached to the borehole string.

Embodiment 19

The method of any prior embodiment, wherein connecting one or more communication devices along a length of a conductor comprises welding and/or pressure testing the connections of the one or more communication devices along the length of a conductor.

Embodiment 20

The method of any prior embodiment, wherein the deployment device comprises a spool and the method further comprises at least one of manually operating and automatically operating the spool.

In support of the teachings herein, various analysis components may be used, including a digital and/or an analog system. For example, the processing unit 26, sensors 40, 42, 44, and/or the spool 46 may include digital and/or analog systems. The system may have components such as a processor, storage media, memory, input, output, communications link (wired, wireless, optical or other), user interfaces a display or printer), software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs. RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a power supply (e.g., at least one of a generator, a remote supply and a battery, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The terms "including" and "having" and the like are intended to be inclusive such that there may be additional elements other than the elements listed. The conjunction "or" when used with a list of at least two terms is intended to mean any term or combination of terms. The term "configured" relates to one or more structural limitations of a device that are required for the device to perform the function or operation for which the device is configured.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

The disclosure illustratively disclosed herein may be practiced in the absence of any element which is not specifically disclosed herein.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

The invention claimed is:

1. An apparatus for deploying one or more components of a borehole monitoring system, the apparatus comprising:

a conductor assembly comprising a plurality of communication devices connected to and arrayed along a length of a conductor, each communication device being configured to wirelessly communicate data and/or power with a downhole device, the conductor configured to transmit the data and/or the power through a borehole in an earth formation; and a deployment device comprising a spool and configured to transport and support the length of the conductor comprising the one or more communication devices connected along the length of the conductor and deploy the length of the conductor in the borehole.

2. The apparatus of claim 1, wherein the spool is configured to be at least one of manually operated and automatically operated.

3. The apparatus of claim 1, wherein a location of each communication device in the plurality corresponds to a selected location on a borehole string deployed in the borehole.

4. The apparatus of claim 3, further comprising a plurality of carriers fixed to the borehole string, each of the carriers being configured to have at least one of the communication devices attached thereto.

5. The apparatus of claim 4, wherein the one or more carriers are spaced along the borehole string to correspond with the location of each communication device.

6. The apparatus of claim 5, wherein each of the communication devices is secured to a corresponding carrier.

7. The apparatus of claim 5, wherein at least one carrier is configured to have the downhole device attached thereto, the downhole device being configured to communicate the data and/or the power with a corresponding communication device also attached to the at least one carrier.

8. The apparatus of claim 1, wherein the downhole device is a sensor.

9. The apparatus of claim 8, wherein the sensor is configured to sense at least one of pressure, temperature, strain, and vibration.

10. The apparatus of claim 1, wherein the downhole device is secured to a casing lining the borehole.

11. The apparatus of claim 1, wherein the downhole device is secured to a borehole string deployed in the borehole.

12. An apparatus for deploying one or more components of a borehole monitoring system, the apparatus comprising:

a conductor assembly comprising a plurality of communication devices connected to and arrayed along a length of a conductor, each communication device being configured to wirelessly communicate data and/or power with a downhole device, the conductor configured to transmit the data and/or the power through a borehole in an earth formation; and a deployment device configured to transport and support the length of the conductor comprising the one or more communication devices connected along the length of the conductor and deploy the length of the conductor in the borehole;

wherein the conductor is encapsulated by tubing to form a tubing encapsulated conductor (TEC).

13. The apparatus of claim 1, wherein each communication device is configured to wirelessly communicate the data and/or power using at least one of acoustic energy and electromagnetic energy.

14. A method for deploying one or more components of a borehole monitoring system, the method comprising:

connecting a plurality of communication devices arrayed along a length of a conductor in a controlled environment to form a conductor assembly, each communication device being configured to wirelessly communicate data and/or power to a downhole device, the conductor configured to transmit the data and/or the power through a borehole in an earth formation;

loading the conductor assembly onto a deployment device comprising a spool and configured to transport and support the length of the conductor comprising the one or more communication devices connected along the length of the conductor and deploy the length of the conductor in the borehole; and deploying the conductor assembly from the deployment device into the borehole.

15. The method of claim 14, wherein deploying the conductor assembly comprises:

attaching a first length of the conductor assembly to a first length of a borehole string;

deploying the first length of the borehole string into the borehole;

attaching a following length of the conductor assembly to a following length of the borehole string;

deploying the following length of the borehole string into the borehole; and iterating the attaching a following length of the conductor assembly and the deploying the following length of the borehole string until a selected length of the conductor assembly is deployed into the borehole.

16. The method of claim 15, wherein at least one of attaching a first length and attaching a following length comprises securing one or more of the communication devices to a carrier attached to the borehole string.

17. The method of claim 14, wherein connecting the plurality of communication devices along a length of a conductor comprises welding and/or pressure testing the connections of the one or more communication devices along the length of a conductor.

18. The method of claim 14, wherein the method further comprises at least one of manually operating and automatically operating the spool.

* * * * *